United States Patent [19]

Knoke et al.

[11] Patent Number: 4,465,723

[45] Date of Patent: Aug. 14, 1984

[54] FIXATION INSERT WITH IMPROVED FLASH-THROUGH SAFETY AND METHOD FOR MANUFACTURING THE SAME

[75] Inventors: Jürgen Knoke, Weinheim; Holger Buchwald, Hemsbach; Jürgen Fehlhaber, Gorxheimertal, all of Fed. Rep. of Germany

[73] Assignee: Firma Carl Freudenberg, Weinheim, Fed. Rep. of Germany

[21] Appl. No.: 387,533

[22] Filed: Jun. 11, 1982

[30] Foreign Application Priority Data

Nov. 13, 1981 [DE] Fed. Rep. of Germany ..... 3145138

[51] Int. Cl.[3] ..... B32B 33/00

[52] U.S. Cl. ..... 428/90; 156/72; 427/200; 427/206; 428/40; 428/200

[58] Field of Search ..... 428/90, 40, 200; 156/72; 427/200, 206

[56] References Cited

U.S. PATENT DOCUMENTS

| | | | |
|---|---|---|---|
| 3,257,743 | 6/1966 | Closson | 428/90 |
| 3,459,579 | 8/1969 | Newman | 117/33 |
| 3,903,331 | 9/1975 | Klein | 427/206 |

*Primary Examiner*—Marion McCamish

*Attorney, Agent, or Firm*—Kenyon & Kenyon

[57] ABSTRACT

Disclosed herein is a fixation insert having improved resistance to back-riveting (flash-through) and a method for the manufacture thereof, consisting of a planar textile structure of natural and/or synthetic threads and a coating, applied to the front side, of a thermally softenable adhesive compound, where the planar structure has at least on the back side a layer of fibers which extend beyond the surface of the planar structure predominantly perpendicularly, and where the fibers are elastically resilient. The fibers are elastically connected to the threads and are deposited thereon in an electrostatic field.

17 Claims, 1 Drawing Figure

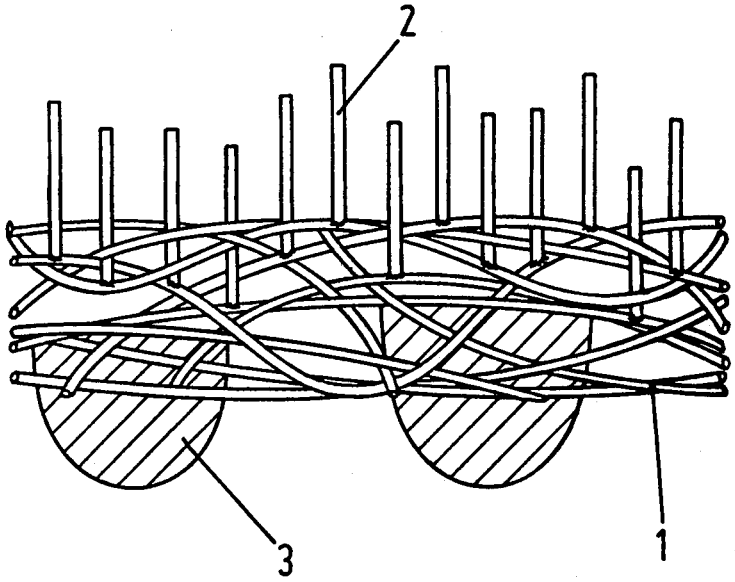
2
3
1

FIXATION INSERT WITH IMPROVED FLASH-THROUGH SAFETY AND METHOD FOR MANUFACTURING THE SAME

BACKGROUND OF THE INVENTION

The present invention relates to a fixation insert having improved "back riveting" ("flash-through") safety, consisting of a planar textile structure of natural and/or synthetic threads or fibers and a coating of a thermally softenable adhesive compound applied on the front of the structure.

Fixation inserts are materials with stiffening action which can be cemented to the inside or back of outer materials by a coating of adhesive compound and which impart to the outer materials the desired fashionable drape, fit and feel.

It is desirable to make fixation inserts of as light a weight as possible so as to increase the "breathing" ability of the overall material, ensure wearing comfort and minimize material costs.

Fixation inserts are provided on their surface with a layer of thermoplastically softenable adhesive compound, usually in a geometric pattern. The inserts are placed with this layer on the back of the outer material and subsequently ironed over. In the ironing process, the adhesive compound is thermally softened. It enters into an adhesive bond with the inside of the outer material, and more or less firm adhesion results after cooling.

An intended effect on the property of the outer material is possible only if the adhesion achieved between the fixation insert and the outer material is of high quality, i.e., if the amount of thermoplastic adhesive compound per unit area does not fall below a certain minimum. In the case of light weight fixation inserts, for example, those of planar textile structures with an area weight of less than 60 g/m$^2$, considerable difficulties can arise since the required amount of adhesive compound can easily penetrate through the planar structure to the back thereof and not only dirty the ironing apparatus but can also make it stick to the planar structure. In this case, the term "back-riveting" or "flash-through" is used to describe this extremely undesirable effect.

To overcome these difficulties, it has been proposed to use only heavy weight non-woven fabrics with an area weight of, for example, more than 70 g/m$^2$ for the production of fixation inserts. A decrease in the breathing ability of the materials, however, must be tolerated in such a case.

DE-AS No. 24 61 845 relates to a fixation insert of a woven or knit fabric or a non-woven fabric, on the top side of which a bonding agent is applied in a fine, raster-shaped print under a correspondingly large amount of adhesive compound. The bonding agent is chemically cross-linked, whereby it is unable to soften during the ironing operation. It can, therefore, block the pore structure of the planar structure during the softening of the adhesive compound and in this manner prevent the adhesive compound from penetrating through the planar structure. The application of defined amounts of the bonding agent and the adhesive compound in closely adjacent zones with a diameter of 0.5 to 1 mm in working widths of more than 1 m, however, is so trouble-prone that the manufacture of such fixation inserts on a large commercial scale is problematical.

From Krema, Handbuch der Textilstoffe, Deutscher Fachverlag GmbH, Frankfurt, 1970, page 191–192, it is known to cover a base material provided with an adhesive layer from above or below with short fibers in an electrostatic field.

SUMMARY OF THE INVENTION

It is an object of the present invention to provide a fixation insert having improved back-riveting or flash-through safety which is easy to produce and which permits the use of planar structures with reduced area weight.

This and other objects are achieved by the provision of a fixation insert of the type mentioned at the outset wherein the planar structure has, at least on the back side thereof, a fiber layer of elastically resilient fibers which extend from the surface substantially perpendicularly.

As a rule, planar textile structures have fiber ends or loops which extend freely from the surface. However, these are not oriented predominantly perpendicularly and they are bound and sized so that there is no measurable elastic resiliency.

The fixation insert of the present invention, on the other hand, has fibers which extend over the surface substantially perpendicularly and have measurable elastic resiliency. As a consequence, the fibers can be laid-over on one side, without reduction of their elasticity, under the action of a lateral force (for example, the pressure of an ironing plate) and to push the still warm planar structure away therefrom, avoiding back-riveting, when the pressure is released. With respect to the overall weight of the required amount of fibers, surprisingly considerable savings are obtained. Area weights of 18 to 20 g/m$^2$ with 12 to 14 g/m$^2$ fiber weight of the base material can be realized without difficulty. The mechanical properties of the available fiber materials can be brought to bear in an optimum manner, as referred to the starting weight, and improved drapability and improved feel are obtained as further advantages.

The planar structure may consist of a woven or knit fabric and/or non-woven fabric. It can, therefore, be adapted optimally to different applications. According to one advantageous embodiment, it is provided that the planar structure be built up with several individual layers, with the individual layers being connected to each other in such a manner that the threads of the individual layers are offset relative to each other. Each individual layer need have only very little thickness and may consist, for example, of a very light gauze. Overall, good surface coverage is achieved nevertheless. The fiber layer applied at least to the back side consists preferably of short fibers which are flaked-on in an electrostatic field and joined to the threads of the planar structure by an elastic bonding agent. The short fibers are oriented predominantly perpendicularly to the surface of the planar structure and they are connected at one end elastically to the threads of the planar structure. Also if short fibers of basically inelastic materials are used, for example, of polyamide 6, polyamide 66, polyester, polyacryl, staple fiber or cotton, great elasticity is therefore ensured in all cases.

The flexibility and the textile feel of planar textile structures can be reduced by too high a bonding agent content. In those cases where a bonding agent is required for reinforcing the planar structure, as, for example, in non-woven fabrics, it has been found to be advantageous to utilize the bonding agent required for binding the short fibers at the same time for cementing the fibers of the planar structure together. Furthermore, extremely economical bonding agent consumption results.

The distribution of the bonding agent in the planar structure can be controlled in a targeted manner by adjustment. For example, the bonding agent can be concentrated in laminate-fashion at the crossings of the threads of the planar structure, and the short fibers are then also arranged in these zones. According to another embodiment, a bonding agent is used which envelops the threads of the planar structure in film-fashion without forming special thick spots at the fiber crossings. The short fibers of equal length which are used in the electrostatic deposition are deposited in this case not preferably on the threads of the planar structure which directly touch the front, but penetrate with the same distribution into the spaces between such threads and can therefore be cemented with the threads arranged on the inside. The effect manifests itself particularly distinctly in planar structures which are built up with several layers, the individual threads of which are offset relative to each other. The nap formed by the short fibers exhibits in one such embodiment a uniformly distributed surface showing irregularities with a character that appears particularly textile-like. Feel and drapability are improved greatly in such cases.

The titer of the short fibers used should be 0.5 to 7 dtex for a fiber length of 0.3 to 3 mm, and preferably 1.3 to 3.3 dtex for a fiber length of 0.5 to 1 mm.

It is not absolutely necessary to deposit short fibers on the planar structure in a continuous layer. Indeed, it has been found that extremely high back-riveting safety is obtained even if the fiber layer has interruptions which are distributed over the area in a pattern. The fiber layer may be limited, for example, to circular areas each having a diameter of 1 to 2 mm with the same mutual spacing. Other geometric patterns, signatures, etc. are conceivable without difficulty. For the practical realization it is merely necessary to apply the bonding agent in an appropriate manner to the planar structure, for example, by spraying, impregnating or printing, to apply the short fibers in the electrostatic field, to solidify the bonding agent and to remove the fibers which have not bound in to the structure by suitable means, for example, by suction.

The ratio of the weight of the short fibers per unit area and the weight of the planar structure should be 0.5 to 2.5, referred to the absolute mass of the fibers. The required amount of bonding agent is not affected thereby.

Fixation inserts usually are manufactured by first producing a planar structure of textile fibers and subsequently coating the structure on the front with a thermally softenable adhesive compound. According to the state of the art, the adhesive compound can be applied as a continuous as well as a discontinuous layer; in all cases, however, there if a danger, with decreasing quantity of fibers, of back-riveting when hot-pressing.

According to the present invention, this problem is solved, in a method of the type described above, by the provision that the planar structure is printed or impregnated with an elastic bonding agent; that a layer of short fibers is loosely deposited at least onto the backside of the structure in an electrostatic field; that the bonding agent is cross-linked; and that the front of the planar structure is coated with an adhesive compound. The proposed process can be carried out simply on a large commercial scale. Short fibers which are not bound-in can be suctioned off without loss from the surface of the finished planar structure and used over again. The amount of fibers required to ensure high back-riveting safety is reduced considerably as compared to known methods.

According to a particular embodiment of the present invention, it is provided that the planar structure is solidified prior to the printing or impregnating. In the case of non-woven planar structures, for example, spunbonded fabrics, such solidification is generally used and can be brought about, for example, in the case where thermoplastic fibers are present, by activating the fibers. In all other cases, solidification can be achieved by embedment and subsequent cross-linking of a bonding agent, if desired, in areas spaced from each other. The bending elasticity and stiffening force can be influenced by such solidification in a controlled, predetermined manner, which is of great importance for the later modification of a stiffening insert.

The required adhesive compound can be brushed as a continuous layer on the front side of the planar structure and generated, for example, by sintering a polyethylene powder together. With respect to ensuring improved air permeability, it has been found to be advantageous to print the adhesive compound in a geometric pattern, where the usual geometric distributions can be employed. The area weight of the adhesive compound should be 10 to 25 g/m$^2$ in fixation inserts for use as insert materials in the apparel field, and in fixation inserts for use in automobile ceilings, 15 to 40 g/m$^2$.

Yet additional improvement of the back-riveting or flash-through safety is obtained using a method in which the planar structure is printed from the back with an elastic bonding agent and at the same time, printed from the front, immediately opposite, with a thermally softenable adhesive compound, provided that a fiber layer of short fibers is loosely deposited into the back side of the structure in an electrostatic field. The structure so obtained is subsequently finished at a temperature such that the bonding agent is cross-linked and the adhesive compound dried. The method is suitable primarily for the treatment of planar structures of non-woven fiber material, preferably an unsolidified non-woven fabric, and, in single-stage operation, leads directly to a fixation insert which has an adhesive compound on the front and a fiber nap on the rear side. In such a method, the bonding agent preferably is printed in partial areas which completely cover the partial areas in which the adhesive compound is printed. The partial layers of adhesive compound, which increase in diameter as they are softened and pressed together with the outer material, thereby can not leave the areas of the partial layers covered by the bonding agent. Within this region, the pore structure of the planar structure is largely blocked by the bonding agent, for which reason the adhesive compound cannot flash through, when softening, to the back side of the planar structure.

Any elastically resilient polymer materials may be used as bonding agents. Prefereably, however, photopolymerizable bonding agents are employed. The requirement per unit area is particularly small in this case and it is possible to achieve high operating speeds. The cross-linking is accomplished by ultra-violet radiation.

There are no special limitations with respect to the applicable planar textile structures. To the extent that non-woven fabrics are concerned, these can be produced by a dry or a wet process. The use of spunbonded fabric also is possible.

The fixation insert of the present invention is distinguished from the known inserts by particularly high back-riveting (flash-through) safety which manifests itself particularly in the case of thin, light weight materials having an area weight of less than 60 g/m$^2$. Planar structures of relatively low-quality fibers are distinctly upgraded with respect to dry-cleanability and with respect to washability and abrasion resistance.

The feel of the fixation insert is fuller and bulkier and these properties are preserved even after hot pressing. The air permeability and the breathing activity of the insert are not impaired at all.

The above-described fixable insert materials for apparel are also particularly well suited for use as fixable textile interior linings that can be ironed-on in self-supporting car ceiling systems in the automotive industry. It is known that the carrier materials in such cases consist of fully impregnated cardboard, Styropor, phenolic resin, grained cotton fiber fabrics or non-woven glass fiber fabric which are deformable in a pressing operation under the action of heat. It is the purpose of these car ceilings not only to reduce the labor effort and to have a heat-insulating effect but also to bring about substantial improvement in the acoustical characteristics of the interior of the vehicle by providing a sound-insulating or sound-absorbing effect. To this end, the self-supporting car ceilings which are produced so as to be as light weight as possible, must have a defined air permeability, i.e., a favorable flow resistance. For this reason, air-permeable foam systems or perforated material have recently been used for such purposes.

The corresponding textile inside lining which can be cemented to the car ceiling also has the purpose to be deformed during the heat pressing and to be cemented to the carrier in the process. The acoustic effect of the car ceiling system is not adversely affected by the adhesive compound which is applied in dot or raster fashion, as compared to application of the adhesive over the entire area, but can even be improved, depending on the choice of the raster or dot size and dot density, and can thereby exert a positive influence on the flow resistance. Deposition of short fibers according to the present invention makes possible the use of planar textile structures having a low weight per square meter while preserving good abrasion resistance and good appearance, and preventing "back-riveting" of the adhesive compound from taking place at the molds during the deformation and cementing, which otherwise might lead to disturbances in the manufacture and to contamination of the surfaces.

BRIEF DESCRIPTION OF THE DRAWING

A non-woven fabric according to the present invention is shown schematically in the attached drawing in a longitudinal section.

DETAILED DESCRIPTION OF THE INVENTION

The non-woven fabric shown in the drawing is constructed of one layer and consists of threads 1 which are united to form an open thread structure. The threads are impregnated continuously with a bonding agent film, not shown, into which the ends of the short fibers 2 are bound, which are deposited perpendicularly. The short fibers 2 have the same length relative to each other but, because the position of their attachment at the individual threads differs, they extend beyond the surface of the non-woven fabric at different heights, whereby the fabric is given a regular/irregular textile-like appearance. Because of their own elasticity and the elasticity of the bonding agent, the short fibers can be bent elastically to one side and straighten out again automatically when the load is released. They therefore act as spacers and prevent direct mechanical contact between the flatiron and the surface of the threads 1 coated with the bonding agent if they are wetted with the adhesive compound 3 which is thermoplastically softened in hot-pressing. Sticking between the non-woven fabric and the ironing device, the so-called back riveting (flash-through), is prevented in this manner.

The term "open thread structure" or "open fiber structure" in the sense of the present invention is understood to mean a thread distribution in which the threads reach distances between their contact points which are at least 5 to 20-times as large as the diameter of the flake-deposited short fibers.

The subject of the present invention is explained in greater detail with reference to the following examples.

EXAMPLE 1

A length-wise oriented carded non-woven fabric of 14 g/m$^2$ of 100% polyethylene terephthalate fibers with a titer of 1.3 dtex and a cut length of 38 mm is impregnated with a bonding-agent polymer dispersion of butylacrylate, methylolacrylamide and acrylonitrile in the ratio 90:4:6, so that 10 g/m$^2$ dry bonding agent are present in the finished product. Onto the impregnated, still wet non-woven fabric, 10 g/m$^2$ short-cut fibers of nylon 6.6 with a titer of 1.7 dtex and a cut length of 0.75 mm are applied in an electrostatic field. Subsequently the flaked fibers are bound-in simultaneously in a suitable drier and the bonding of the fiber fabric, the drying and cross-linking of the bonding agent take place.

In a second operation an adhesive compound of copolyamide at a 17-mesh distance and a coating of 14 g/m$^2$ is applied and dried.

When this non-woven fabric, which contains 24 g/m$^2$ fibers, among them 10 g/m$^2$ flaked-on short fibers, is ironed to an outer material on an ironing press for 10 seconds at 150° C., 350 mbar, it remains lying flat on the lower plate after the press is opened, which indicates freedom from back-riveting. In a non-woven fabric with 24 g/m$^2$ polyester fibers, bound completely, but without flaked-on short fibers, the adhesive compound flashes through under the same conditions, and the laminate is stuck to the top side of the ironing board.

In the determination of the drapability according to DIN 54 306, the non-woven fabric exhibited distinctly better drapability as compared to an insert having the same fiber content and weight per square meter (but without short fibers bound therein), as confirmed by the following values:

Flaked goods from Example 1: 55.33%

Not-flaked goods: 65.73%

In the test for air permeability according to DIN 53 887, it was found that a light weight non-woven fabric with high air permeability barely looses its permeability property if an additional 10 g/m$^2$ short fibers are applied perpendicularly to the surface. If, however, the same amount of 10 g/m$^2$ fibers is incorporated into the base fabric, the air permeability decreases (in proportion to the increasing fiber content per m$^2$). This is confirmed by control measurements, the results of which are given below, on non-woven fabrics with comparable fiber content.

Air permeability under a pressure of 0.5 mbar:

non-flaked goods, 24 g/m² fiber: 1250 l/sec m²
flaked goods, 24 g/m² fiber: 1600 l/sec m²
non flaked goods, 14 g/m² fiber: 1800 l/sec m²

EXAMPLE 2

A carded and cross-laid non-woven fabric of 22 g/m² of a mixture of 80% polyethylene terephthalate fibers with a titer of 1.7 dtex and 20% copolyester fibers of polyethylene terephthalate and polybutylene terephthalate with a melting point of 190° C. are welded together under pressure and heat in raster-fashion.

Subsequently, 8 g/m² of a condensed bonding agent dispersion of butylacrylate-methylolacrylamide and acrylonitrile polymerizate are applied in a ratio of 90:4:6 at a 25-mesh distance and the fabric is conducted into an electrostatic field, in which 10 g/m² short-cut fibers of polyethylene terephthalate with a titer of 1.7 dtex and a cut length of 0.75 mm are applied. The flaked short-cut fibers are bound-in and the bonding agent is dried and cross-linked in a drier. Subsequent cleaning via brush cylinders with suction removes the excess short fibers which are not bound in to the fabric.

In a further operation, an adhesive compound of copolyamide is applied dry at a 17-mesh distance with a coating thickness of 14 g/m² on the backside and is dried. When this non-woven fabric, which contains 32 g/m² fibers, among which are 10 g/m² flaked-on short fibers, is hot-pressed onto an outer material for 10 seconds at 150° C., 350 mbar on a fixation ironing press, it remains flat on the lower plate after the press is opened, which indicates freedom from back-riveting of the adhesive compound. In a non-woven fabric with 32 g/m² polyester fibers bound completely, without flaked-on short fibers, the adhesive compound flashes through under the same conditions, and the laminate sticks to the upper side of the plate.

The two non-woven fabrics differ as to drapability according to DIN 54 306 in the same manner as in accordance with Example 1. For the air permeability according to DIN 53 887, the observations of Example 1 also apply.

EXAMPLE 3

A carded lengthwise-oriented non-woven fabric of 14 g/m² of 100% polyethylene terephthalate fibers with a titer of 1.3 dtex and a fiber length of 38 mm is applied, as described in DE-OS No. 29 14 617, in one operation from the one side with 10 g/m² bonding agent (dry) of butyacrylate-methylolacrylamide and acrylonitrile in the ratio of 90:4:6 and from the other side, 14 g/m² (dry) of an adhesive compound of copolyamide is applied, always exactly opposite the bonding agent, at a 25-mesh distance. The undried fabric is brought into an electrostatic field in which 10 g/m² short fibers of nylon 6.6 (titer of 1.7 dtex and a cut length of 0.75 mm) are applied on the side where the bonding agent was applied. In the subsequent drier, the bonding agent is cross-linked and the adhesive compound is dried. Cleaning via brushing cylinders with suction removes the excess, short fibers which are not bound in to the fabric.

When this non-woven fabric, which contains 24 g/m² fibers, among them 10 g/m² short fibers, is hot-pressed on an outer material for 10 seconds, at 150° C. and 350 mbar on a fixing plate press, it remains lying flat after the press is opened, which indicates freedom from back-riveting of the adhesive compound. In the case of a non-woven fabric with 24 g/m² polyester fibers, completely bound and without applied short fibers, the adhesive compound flashes through under the same conditions and the laminate sticks to the upper side of the plate.

The two non-woven fabrics differ as to drapability according to DIN 54 306 in the same manner as according to Example 1.

For the air permeability according to DIN 53 887, the same observations apply for this Example as in the preceding Example 1.

What is claimed is:

1. A fixation insert which resists back-riveting when applied by hot-pressing to an outer material, comprising a planar textile structure of natural and/or synthetic threads having coated on a front side thereof a thermally softenable adhesive compound and, on a back side thereof, having a layer of elastically resilient fibers predominantly protruding perpendicularly from the surface of said structure and elastically connected directly to the threads of said structure.

2. The fixation insert according to claim 1 wherein said planar structure is selected from the group consisting of woven, knit and non-woven fabrics, and combinations thereof.

3. The fixation insert according to claim 1 wherein said planar structure is built up of several layers and wherein the threads of the individual layers are offset relative to each other.

4. The fixation insert according to claim 1 wherein said layer of fibers consists of short fibers which are flaked-on to the planar structure in an electrostatic field and are cemented by an elastic bonding agent to the threads of the planar structure.

5. The fixation insert according to claim 4 wherein said bonding agent cements the threads of said planar structure together.

6. The fixation insert according to claim 4 wherein said bonding agent is concentrated in the form of laminations at the crossings of said threads.

7. The fixation insert according to claim 4 wherein said bonding agent envelops the threads of the planar structure in film-fashion.

8. The fixation insert according to claim 1 wherein said short fibers are selected from the group consisting of polyamide 6, polyamide 66, polyester, polyacryl, staple fiber and cotton.

9. The fixation insert according to claim 8 wherein the titer of said short fibers is about 0.5 to 7 dtex for a length of about 0.3 to 3.0 mm.

10. The fixation insert according to claim 8 wherein the titer of the fibers is 1.0 to 3.3 dtex for a length of 0.5 to 1 mm.

11. The fixation insert according to claim 1 wherein said fiber layer has interruptions which are distributed over the area in pattern-fashion.

12. The fixation insert according to claim 1 wherein the ratio of the weight of the fiber layer per unit area to the weight of the corresponding planar structure is 0.8:1 to 2.5:1, referred to the pure fiber mass.

13. A method for manufacturing a fixation insert which resists back-riveting when applied by hot-pressing to an outer material, comprising the steps of:

(a) forming a planar structure of natural and/or synthetic threads;

(b) printing or impregnating an elastic bonding agent onto a back side of said planar structure;

(c) applying short fibers to said back side of the planar structure in an electrostatic field;

(d) heating said planar structure to dry and cross-link said bonding agent, thereby cementing together the threads of said planar structure and binding said short fibers to the threads of said planar structure; and (e) applying an adhesive compound to the front side of said planar structure.

14. The method according to claim 13 wherein said planar structure of step (a) is solidified before being printed or impregnated in step (b).

15. The method according to claim 13 wherein said bonding agent is photopolymerizable by ultraviolet radiation.

16. A method for the manufacture of a fixation insert which resists back-riveting when applied by hot-pressing to an outer material, comprising the steps of:

(a) forming a planar structure of natural and/or synthetic threads;

(b) simultaneously applying, respectively, to immediately opposed areas of the front and back of said planar structure, a thermally softenable adhesive compound and an elastic bonding agent;

(c) applying short fibers to the back side of said planar structure in an electrostatic field; and (d) heating said planar structure so as to dry and cross-link said bonding agent, thereby cementing together the threads of said planar structure and binding said short fibers to the threads of said planar structure.

17. The method according to claim 16 wherein said bonding agent is printed on to said back side of the planar structure in areas which completely cover the areas in which said adhesive compound is printed on to said front side of the textile structure.

* * * * *